US005736498A

United States Patent [19]

Gray

[11] Patent Number: 5,736,498

[45] Date of Patent: Apr. 7, 1998

[54] THICKENED AQUEOUS HYDROGEN PEROXIDE COMPOSITIONS AND METHODS OF MAKING SAME

[75] Inventor: Andrew Kevin Gray, Cheshire, United Kingdom

[73] Assignee: Solvay Interox Limited, Warrington, England

[21] Appl. No.: 617,887

[22] PCT Filed: Sep. 23, 1994

[86] PCT No.: PCT/GB94/02069

§ 371 Date: Mar. 19, 1996

§ 102(e) Date: Mar. 19, 1996

[87] PCT Pub. No.: WO95/09226

PCT Pub. Date: Apr. 6, 1995

[30] Foreign Application Priority Data

Sep. 28, 1993 [GB] United Kingdom ..... 9319943

[51] Int. Cl.[6] ..... C11D 3/39; C11D 3/37; C11D 1/83

[52] U.S. Cl. ..... 510/372; 510/375; 510/421; 510/422; 510/424; 510/426; 510/427; 510/476; 510/477; 510/533; 510/318; 510/238; 252/186.43

[58] Field of Search ..... 510/238, 318, 510/372, 375, 421–427, 434, 398, 475, 476, 533; 252/186.43

[56] References Cited

U.S. PATENT DOCUMENTS 4,130,501 12/1978 Lutz et al. ..... 252/186.43

FOREIGN PATENT DOCUMENTS 376704 7/1990 European Pat. Off. .
404293 12/1990 European Pat. Off. .
9015857 12/1990 WIPO .

*Primary Examiner*—Margaret Einsmann
*Attorney, Agent, or Firm*—Larson & Taylor

[57] ABSTRACT

Neutral or alkaline thickened aqueous hydrogen peroxide compositions and processes for the production thereof are provided. The compositions are thickened with a polymeric thickener comprising a polyethylene backbone, with pendant carboxylate groups and pendant groups of the formula $—(OCH_2CH_2)_m(OCHXCHY)_n—O—R$, where m is a position integer, n is zero or a positive integer, X and Y are independently selected from hydrogen atoms, methyl and ethyl groups and R is a hydrophobic group comprising eight or more carbon atoms; and one or more surfactants selected from the group consisting of alcohol ethyoxylates, alkylbenzenesulphonates comprising ten or more carbon atoms, alkylsulphates comprising six or more carbon atoms, alcohol ether sulphates, alpha-sulphoesters and alkylglucosides.

40 Claims, No Drawings

THICKENED AQUEOUS HYDROGEN PEROXIDE COMPOSITIONS AND METHODS OF MAKING SAME

This invention concerns thickened peroxygen compositions, and more specifically, thickened aqueous alkaline hydrogen peroxide compositions, and processes for the production thereof.

During recent years, there has been considerable interest in the use of peroxygen compositions, particularly hydrogen peroxide compositions, as replacements for or alternatives to halogen-containing disinfectants and/or bleaches. Much interest has been focused on the use of alkaline hydrogen peroxide compositions, because of the known superior bleaching performance of such compositions compared with acidic hydrogen peroxide compositions.

Disinfectant and bleaching compositions, particularly, though not exclusively intended for domestic use are often employed to disinfect non-horizontal surfaces. It is therefore often desirable that such compositions are thickened, for example, in order to reduce the rate at which the compositions flow off the surfaces, thereby increasing the contact time with the composition.

Many common thickening agents for alkaline systems, for example xanthan gums and cellulose-based thickeners are not suitable for use with hydrogen peroxide on account of their being oxidatively degraded, and hence rapidly losing their thickening ability. One alternative thickening system that has been proposed by Akzo in European patent application no 0 265 979 is a combination of a quaternary ammonium compound plus a short chain alkylaryl sulphonate, such as sodium xylenesulphonate. Unfortunately, the use of quaternary ammonium compounds has come under pressure on environmental grounds because they commonly exhibit relatively poor biodegradability. Additionally, quaternary ammonium compound plus short chain alkylaryl sulphonate thickened systems commonly exhibit a high degree of viscoelasticity, thus possessing undesirable flow characteristics. To some extent, this problem can be avoided or ameliorated by the addition of a perfume, but in certain applications, it is undesirable to add a perfume.

It is an object of certain aspects of the present invention to provide thickened aqueous neutral or alkaline hydrogen peroxide compositions avoiding the problems of quaternary ammonium-based systems.

It is a second object of further aspects of the present invention to provide a process for the production of thickened aqueous neutral or alkaline hydrogen peroxide compositions which avoid the problems of quaternary ammonium-based systems.

According to one aspect of the present invention, there is provided neutral or alkaline thickened aqueous hydrogen peroxide compositions, characterised in that the compositions comprise an effective thickening amount of:

i. a polymer comprising a polyethylene backbone with pendant carboxylate groups and pendant groups having the general chemical formula:

—$(OCH_2CH_2)_m(OCHXCHY)_n$—O—R, where m is a positive integer, n is zero or a positive integer, X and Y are independently selected from hydrogen atoms, methyl and ethyl groups and R is a hydrophobic group comprising 8 or more carbon atoms; and ii. one or more surfactants selected from the group consisting of alcohol ethoxylates, alkylbenzenesulphonates comprising 10 or more carbon atoms, alkylsulphates comprising 6 or more carbon atoms, alcohol ether sulphates, alpha-sulphoesters and alkylglucosides.

According to a second aspect of the present invention, there is provided a process for the production of neutral or alkaline thickened aqueous hydrogen peroxide compositions, characterised in that to an aqueous hydrogen peroxide solution is added an effective thickening amount of:

i. a polymer comprising a polyethylene backbone with pendant carboxylate groups and pendant groups having the general chemical formula:

—$(OCH_2CH_2)_m(OCHXCHY)_n$—O—R, where m is a positive integer, n is zero or a positive integer, X and Y are independently selected from hydrogen atoms, methyl and ethyl groups and R is a hydrophobic group comprising 8 or more carbon atoms; and ii. one or more surfactants selected from the group consisting of alcohol ethoxylates, alkylbenzenesulphonates comprising 10 or more carbon atoms, alkylsulphates comprising 6 or more carbon atoms and alkylglucosides, and the pH of the hydrogen peroxide is adjusted to neutral or alkaline pH.

The polymers that are employed in the compositions and process according to the present invention comprise a polyethylene backbone. Such a backbone is commonly produced by the polymerisation of an ethylenically unsaturated compound and comprises concatenated saturated carbon atoms. In addition to the pendant carboxylic acid groups and groups having the formula —$(OCH_2CH_2)_m(OCHXCHY)_n$—O—R, the polymers can comprise pendant alkyl groups, especially short chain alkyl groups such as methyl or ethyl groups.

The pendant carboxylate groups can be bonded directly to the polyethylene backbone, or can be separated therefrom by a suitable connecting group, for example a saturated hydrocarbyl chain. The carboxylate groups can be present either as free carboxylic acid groups, but on account of the pH of the compositions, the carboxylate groups are most likely to be present in salt form.

The pendant groups having the formula —$(OCH_2CH_2)_m(OCHXCHY)_n$—O—R can be bonded directly to the polyethylene backbone, or can be connected via a suitable connecting group. Suitable connecting groups will be readily apparent to those skilled in the art, and in many instances will be selected from the group consisting of saturated hydrocarbyl groups, carbonyl groups and amido groups. Preferably, the connecting groups comprise from 1 to 4 carbon atoms. In the formula, m represents a positive integer, and is usually 2 or greater, often greater than 10 and most often greater than 20, and unlikely to be greater than 100. In the compounds, n represents zero or a positive integer. Usually n is 0, but if not, n is often less than m. R represents a hydrophobic group comprising at least 8 carbon atoms. R can be a linear, branched or cyclic alkyl group, an optionally substituted alkaryl group or an optionally substituted aralkyl group. Preferably, R does not contain more than 24 carbons, and particularly preferably not more than 18 carbons.

A particularly preferred group of polymers are those commercially available from Allied Colloids Limited in the United Kingdom in August 1993 under the trademarks "Rheovis CR", "Rheovis CRX" and "Rheovis CR3". It is believed that the effectiveness at thickening of these polymers in conjunction with surfactants attributable to association of the pendant groups of formula —$(OCH_2CH_2)_m(OCHXCHY)_n$—O—R with themselves and with surfactant micelles, and also to the swelling nature of the polymer resulting from the pendant carboxyl groups.

The concentration of polymer in the compositions according to the present invention can be varied widely, depending, for example, on the viscosity it is desired to produce. The concentration is commonly in the range of from about 0.1% w/w to about 10% w/w, and is more commonly in the range from about 0.5% w/w to about 5% w/w.

The surfactants that are employed in conjunction with any of the aforementioned polymers in the compositions and processes according to the present invention are selected from the group consisting of alcohol ethoxylates, alkylbenzenesulphonates comprising 10 or more carbon atoms, alkylsulphates comprising 6 or more carbon atoms and alkylglucosides. A mixture of two or more surfactants can be employed, particularly a mixture of a nonionic surfactant with an anionic surfactant. It may be particularly desirable to employ a mixture of surfactants when a nonionic surfactant having a low HLB is employed. Such low HLB surfactants are often poorly soluble in water and can result in the formation of cloudy solutions. The use of a mixture of surfactants can help overcome this problem in addition to providing other benefits, such as improved cleaning or detergency.

Suitable alcohol ethoxylates comprise alkylphenol ethoxylates, secondary alcohol ethoxylates and linear or branched primary alcohol ethoxylates. Most preferably, the alcohol ethoxylate is a linear primary alcohol ethoxylate. Suitable alcohol ethoxylates include those having an alkyl moiety comprising from 8 to about 22, often from 9 to about 18 carbon atoms. The number of ethoxylate groups in the alcohol ethoxylate is often 2 or more, most often from 3 to about 30. Preferably, the number of ethoxylates is from about 4 to about 16. In certain embodiments, good results have been achieved when the alcohol ethoxylate comprises from 6 to 9 ethoxylates. The alcohol ethoxylate can be capped with a low molecular weight alkyl or aryl group such as a methyl, ethyl, iso-propyl, tertiary butyl or benzyl group, but is preferably not capped.

Suitable alkylbenzenesulphonates include linear and branched alkylbenzenesulphonates, with linear alkylbenzenesulphonates being preferred. Preferably, the alkyl moiety comprises from 6 to 18 carbon atoms, more preferably from 10 to 14 carbon atoms. The most preferred alkylbenzenesulphonate is dodecylbenzenesulphonate.

Suitable alkylsulphates include linear and branched alkylsulphates. Examples of suitable alkylsulphates include sodium 2-ethylhexylsulphate and sodium laurylsulphate. A further suitable class of akylsulphates is alkyl ether sulphates wherein the sulphate group is bonded to the alkyl group via one or more, such as from 2 to 6, ethoxylate groups.

Alkylglucosides that can be employed in the process have the general chemical formula R—C—$(G)_n$ where R represents an alkyl chain, G represents a glucosidic moiety and n represents a positive integer. R can be derived from natural products or from synthetically, and often comprises from 8 to 18 carbon atoms. In many suitable alkylglucosides, n is from 1 to 5.

The concentration of surfactant in the compositions according to the present invention is usually greater than about 0.1% w/w, often greater than about 0.25% w/w, and is unlikely to be greater than about 10% w/w. Preferably, the concentration of surfactant is from about 0.5% to about 5% w/w.

The weight ratio of polymer to surfactant in the compositions according to the present invention can be selected from a wide range, depending on the properties desired of the composition. In many cases, the weight ratio of polymer to surfactant will be selected in the range of from about 0.1 to 1 to about 10:1, often from about 0.25:1 to 7.5:1, more often from about 0.4:1 to about 5:1. In certain embodiments, good results have been achieved employing a weight ratio of polymer to surfactant in the range from 0.5:1 to 3:1.

The compositions according to the present invention can comprise hydrogen peroxide at a very wide range of concentrations. However, for many applications, the concentration of hydrogen peroxide is unlikely to be below about 1% w/w or greater than about 35% w/w, and is often in the range of from about 3% w/w to about 20% w/w.

The compositions according to the present invention can be produced by dilution of a concentrated aqueous solution of hydrogen peroxide. However, it will be recognised that it is possible to employ alternative sources of hydrogen peroxide, including persalts such as sodium percarbonate, sodium perborate mono- and tetrahydrates and addition compounds such as urea-peroxide which dissolve to at least some extent in the compositions, but which may also provide a particulate residue.

The compositions according to the present invention have a neutral or alkaline pH. In the present invention, the term neutral pH means a pH in the region of about 6 or higher. The pH of the compositions is generally not higher than about 11, and is commonly in the range of from about 7.2 to about 10, particularly from about 7.5 to about 9.5.

Compositions according to the present invention can be produced in a wide range of viscosities, ranging from relatively free-flowing to gels. The amount of thickening system employed is often sufficient to produce an initial viscosity greater than about 50 cPs, and usually greater than about 100 cPs. In many instances, the compositions have an initial viscosity in the range of from about 200 cPs to about 5,000 cPs. In certain aspects of the present invention, especially when the surfactant employed comprises an alcohol ethoxylate, the thickening system is chosen such that the viscosity produced is initially relatively low, but which increases on storage, for example over periods of from 1 day to 20 or more days, such as 4 or 5 to 10 days. This is advantageous in certain circumstances as it permits relatively easy handling of the compositions, for example mixing and packaging, with the composition reaching a higher viscosity on storage.

In addition to the components described hereinbefore, the compositions can comprise one or more additional components, commonly selected from stabilisers for the hydrogen peroxide, buffers, dyes and perfumes. Particularly suitable stabilisers include aminopolyphosphonic acids and salts thereof, and are commonly employed at from about 0.01%, preferably from about 0.1% up to about 3% by weight of the composition. Preferably, the stabiliser is cyclohexyl-1,2-diaminotetramethylene phosphonic acid and salts thereof. It will be recognised that the compositions can also contain additional stabilisers which may, at least in part, originate from the dilution of a stabilised concentrated hydrogen peroxide solution. Examples of such additional stabilisers include phosphates and stannates. Buffers are employed in an amount to produce the desired pH of the composition. Preferably, the buffer comprises sodium benzoate.

The compositions according to the present invention can be prepared by charging the desired components to a suitable vessel and agitating, for example, with a mechanical stirrer. The compositions are normally prepared at ambient temperature, for example from 15° to about 30° C. It will be recognised that hydrogen peroxide is usually available commercially as a relatively concentrated aqueous acidic solution. To obtain the invention compositions therefrom, it is usual for there to be dilution and adjustment of the pH.

Preferably, the dilution occurs prior to the adjustment of pH. The pH adjustment, which commonly comprises the addition of an alkali, for example sodium hydroxide, can be effected before or after the addition of the other component. However, preferably, the pH adjustment is effected after the addition of the other components.

Having described the invention in general terms, specific embodiments thereof are described in greater detail by way of example only. All percentages are w/w on the composition unless specified.

EXAMPLE 1

28.46 g of an aqueous solution of 35% hydrogen peroxide containing 1.2% cyclohexyl-1,2-diaminotetramethylene phosphonic acid (CDTMP) was diluted with 140 g demineralised water. To this was added, with stirring, 4 g of the product commercially available from Allied Colloids Limited in the UK in August 1993 under the Trade Mark "Rheovis CRX" containing a carboxylate-bearing polymer, 2 g of alcohol ethoxylate surfactant having a $C_{13-15}$ alkyl moiety and 9 ethoxylate groups commercially available in the UK from Cargo Fleet Chemicals under the Trade Mark Synperonic A9, 3 g sodium benzoate and 0.1 g perfume, available in the UK from Bush Boake Allen Limited under the Trade Name LK30524. The pH was adjusted to 9.5 by the addition of sodium hydroxide solution (12% aqueous solution). The composition was then made up to 200 g with further demineralised water.

The composition produced had an initial viscosity (Brookfield RVT, Spindle 2 at 50 rpm) of 100 cPs. After 20 days storage at 32° C. and 80% Relative Humidity, the composition retained 87% of its hydrogen peroxide and had a viscosity of 252 cPs.

EXAMPLE 2

The procedure of Example 1 was repeated, except that 4 g of the product commercially available from Allied Colloids Limited in the UK in August 1993 under the Trade Mark "Rheovis CR3" was employed instead of the product having the Trade Mark "Rheovis CRX".

The composition produced had an initial viscosity (Brookfield RVT, Spindle 2 at 50 rpm) of 216 cPs. After 28 days storage at 32° C. and 80% Relative Humidity, the composition. retained 88% of its hydrogen peroxide and had a viscosity of 372 cPs.

EXAMPLE 3

The procedure of Example 1 was repeated, except that 4 g of the product commercially available from Allied Colloids Limited in the UK in August 1993 under the Trade Mark "Rheovis CR" was employed instead of the product having the Trade Mark "Rheovis CRX".

The composition produced had an initial viscosity (Brookfield RVT, Spindle 2 at 50 rpm) of 192 cPs. After 28 days storage at 32° C. and 80% Relative Humidity, the composition retained 98% of its hydrogen peroxide and had a viscosity of 88 cPs.

EXAMPLE 4

A composition containing 21% hydrogen peroxide, 0.72% (CDTMP), 5% of the polymer commercially available from Allied Colloids Limited in the UK in August 1993 under the Trade Mark "Rheovis CRX", 1% of alcohol ethoxylate surfactant having a $C_9$ alkyl moiety and 8 ethoxylate groups as commercially available in the UK from Cargo Fleet Chemicals Limited under the Trade Mark Synperonic 91/8 at a pH of 6 to 7 was prepared by the general method of Example 1.

The composition produced had an initial viscosity (Brookfield RVT, Spindle 2 at 50 rpm) of 6,000 cPs. After 14 days storage at 32° C. and 80% Relative Humidity, the composition retained 100% of its hydrogen peroxide and had a viscosity of 6,000 cPs.

EXAMPLE 5

The procedure of Example 1 was followed, except that 1.8 g of a solution of an alkylglucoside (33% active by weight) commercially available in the UK from Rohm and Haas was employed in place of the alcohol ethoxylate, and that no sodium benzoate and perfume were employed.

The composition produced had an initial viscosity (Brookfield RVT, Spindle 2 at 50 rpm) of 1,500 cPs. After 4 days storage at ambient temperature (ca. 20° C.) the viscosity of the composition had increased to 3,200 cPs.

EXAMPLE 6

The procedure of Example 5 was followed, except that 0.2% of sodium lauryl sulphate was employed as surfactant.

The composition produced had an initial viscosity (Brookfield RVT, Spindle 2 at 50 rpm) of 1,200 cPs. After 5 days storage at ambient temperature (ca. 20° C.) the viscosity of the composition had increased to 3,800 cPs.

EXAMPLE 7

The procedure of Example 5 was followed, except that 0.7% of a solution (30% active by weight) of a dodecylbenzene sulphonate commercially available in the UK from Cargo Fleet Chemicals under the Trade name Cation NAS 30 was employed as surfactant.

The composition produced had an initial viscosity (Brookfield RVT, Spindle 2 at 50 rpm) of 1,100 cPs. After 5 days storage at ambient temperature (ca. 20° C.) the viscosity of the composition had increased to 4,200 cPs.

EXAMPLE 8

The procedure of Example 5 was followed, except that 0.7% of the alcohol ethoxylate of Example 1, "Synperonic A9", was employed as surfactant.

The composition produced had an initial viscosity (Brookfield RVT, Spindle 2 at 50 rpm) of 1,500 cPs. After 5 days storage at ambient temperature (ca. 20° C.) the viscosity of the composition had increased to 2,500 cPs.

COMPARISON 9

The procedure of Example 1 was followed, but omitting the alcohol ethoxylate surfactant.

The composition produced had a viscosity of only 24 cPs.

COMPARISON 10

The procedure of Example 1 was followed, except that the surfactant employed was 2 g of a material, sorbitan monooleate, as commercially available in the UK under the Trade Mark "Span 80" instead of the alcohol ethoxylate surfactant.

The composition produced was cloudy, and had a viscosity of only 24 cPs.

COMPARISON 11

The procedure of Example 1 was followed, except that the polymer "Rheovis CRX" was omitted.

The composition had a viscosity that was too low to measure using the Brookfield RVT viscometer.

The results of Examples 1 to 4 show that the thickened compositions according to the present invention had both good viscosity and hydrogen peroxide stability over a wide range of viscosities and hydrogen peroxide concentrations. The results of Examples 5 to 8 show that a range of surfactants according to the present invention can be employed to produce a range of viscosities, and that the thickening system can be selected to produce compositions which have a relatively lower initial viscosity, but which increases on storage. The results of Comparisons 9 and 11 show that when either of the thickening components was omitted, namely the polymer or surfactant selected according to the present invention, the thickening effect was significantly reduced. The result of Comparison 10 shows that when a surfactant not according to the present invention was substituted for the surfactant selected in accordance with the present invention, its addition did not increase thickening beyond that of the composition of Comparison 9.

I claim:

1. A neutral or alkaline thickened aqueous hydrogen peroxide composition comprising at least 1% by weight hydrogen peroxide, water and a thickening system comprising:

i. a polymer comprising a polyethylene backbone with pendant carboxylate groups and pendant groups having the general chemical formula: $—(OCH_2CH_2)_m(OCHXCHY)_n—O—R$, where m is a positive integer, n is zero or a positive integer, X and Y are independently selected from hydrogen atoms, methyl and ethyl groups and R is a hydrophobic group comprising 8 or more carbon atoms; and ii. one or more surfactants selected from the group consisting of alcohol ethoxylates, alkylbenzenesulphonates comprising 10 or more carbon atoms, alkysulphates comprising 6 or more carbon atoms, alcohol ether sulphates, alpha-sulphoesters and alkyglucosides, the weight ratio of said polymer to said surfactant being from 0.1 to 1 to 10:1, said thickening system being present in an amount sufficient to impart to the composition a viscosity of greater than 50 cPs.

2. A composition according to claim 1, wherein n is 0.

3. A composition according to claim 1, wherein m is from 2 to 100.

4. A composition according to claim 1, wherein R comprises from 8 to 24 carbon atoms.

5. A composition according to claim 4 wherein R comprises from 8 to 18 carbon atoms.

6. A composition according to claim 1, wherein R comprises a linear, branched or cyclic alkyl group.

7. A composition according to claim 1, 4 or 6, wherein the pendant groups having the formula $—(OCH_2CH_2)_m(OCHXCHY)_n—O—R$ are connected to the backbone by a connecting group selected from the group consisting of saturated hydrocarbyl groups, carbonyl groups and amido groups.

8. A composition according to claim 3, wherein m is from 10 to 100.

9. A composition according to claim 1, wherein said pendant groups having the formula $—(OCH_2CH_2)_m(OCHXCHY)_n—O—R$ are connected to the backbone by a connecting group selected from the group consisting of saturated hydrocarbyl groups, carbonyl groups, and amido groups and wherein R is a linear, branched or cyclic alkyl group of from 8 to 18 carbon atoms.

10. A composition according to claim 1 or 9, wherein the surfactant comprises an alcohol ethoxylate.

11. A composition according to claim 9, wherein the surfactant comprises an alcohol ethoxylate having an alkyl moiety of from 9 to 18 carbon atoms and from 4 to 16 ethoxylate groups, the weight ratio of polymer to surfactant being in the range of from 0.4:1 to 5:1.

12. A composition according to claim 1 or 11, wherein the pH of the composition is from 7.2 to 10.

13. A composition according to claim 12 wherein said pH is from 7.5 to 9.5.

14. A composition according to claim 1 or 11, wherein the viscosity of the composition is from 100 cPs to 5000 cPs.

15. A composition according to claim 14, wherein the viscosity increases on storage.

16. A composition according to claim 1 or 9, wherein the weight ratio of polymer to surfactant is from 0.4:1 to 5:1.

17. A composition according to claim 10, wherein the alcohol ethoxylate comprises an alkyl moiety having from 8 to 22 carbon atoms.

18. A composition according to claim 17 wherein said alkyl moiety comprises from 9 to 18 carbon atoms.

19. A composition according to claim 10, wherein the number of ethoxylate groups in the alcohol ethoxylate is from 2 to 30.

20. A composition according to claim 19 wherein the number of said ethoxylate groups is from 4 to 10.

21. A process for the production of a neutral or alkaline thickened aqueous hydrogen peroxide composition, comprising adding to an aqueous hydrogen peroxide solution containing at least 1% by weight hydrogen peroxide, a thickening system comprising:

i. a polymer comprising a polyethylene backbone with pendant carboxylate groups and pendant groups having the general chemical formula: $—(OCH_2CH_2)_m(OCHXCHY)_n—O—R$, where m is a positive integer, n is zero or a positive integer, X and Y are independently selected from hydrogen atoms, methyl and ethyl groups and R is a hydrophobic group comprising 8 or more carbon atoms; and ii. one or more surfactants selected from the group consisting of alcohol ethoxylates, alkylbenzenesulphonates comprising 10 or more carbon atoms, alkylsulphates comprising 6 or more carbon atoms and alkylglucosides, the weight ratio of said polymer to said surfactant being from 0.1 to 1 to 10:1, said thickening system being present in an amount sufficient to impart to the composition a viscosity of greater than 50 cPs.

22. A process according to claim 21, wherein n is 0.

23. A process according to claim 21, wherein m is from 2 to 100.

24. A process according to claim 23, wherein m is from 10 to 100.

25. A process according to claim 21, wherein R comprises from 8 to 24 carbon atoms.

26. A process according to claim 21, wherein R comprises a linear, branched or cyclic alkyl group.

27. A process according to claim 21, 25 or 26, wherein the pendant groups having the formula $—(OCH_2CH_2)_m(OCHXCHY)_n—O—R$ are connected to the backbone by a connecting group selected from the group consisting of saturated hydrocarbyl groups, carbonyl groups and amido groups.

28. A process according to claim 25, wherein R comprises from 8 to 18 carbon atoms.

29. A process according to claim 21, wherein said pendant groups having the formula $—(OCH_2CH_2)_m(OCHXCHY)_n—O—R$ are connected to the backbone by a connecting group selected from the group consisting of saturated hydrocarbyl groups, carbonyl groups, and amido groups and wherein R is a linear, branched or cyclic alkyl group of from 8 to 18 carbon atoms.

30. A process according to claim 21 or 29, wherein the weight ratio of polymer to surfactant is from about 0.4 to 1 to about 5:1.

31. A process according to claim 21 or 29, wherein the surfactant comprises an alcohol ethoxylate.

32. A process according to claim 31, wherein the number of ethoxylate groups in the alcohol ethoxylate is from 2 to 30.

33. A process according to claim 32, wherein the number of said ethoxylate groups is from 4 to 10.

34. A process according to claim 31, wherein said alcohol ethoxylate comprises an alkyl moiety having from 8 to 22 carbon atoms.

35. A process according to claim 34, wherein said alkyl moiety comprises from 9 to 18 carbon atoms.

36. A process according to claim 29, wherein the surfactant comprises an alcohol ethoxylate having an alkyl moiety of from 9 to 18 carbon atoms and from 4 to 16 ethoxylate groups, the weight ratio of polymer to surfactant being in the range of from 0.4:1 to 5:1.

37. A process according to claim 21 or 36, wherein the viscosity of the composition is from 100 cPs to 5000 cPs.

38. A process according to claim 37, wherein the viscosity increases on storage.

39. A process according to claim 21 or 36, wherein said pH is from 7.2 to 10.

40. A process according to claim 39, wherein said pH is from 7.5 to 9.5.

* * * * *